US008870126B2

(12) United States Patent
Bock et al.

(10) Patent No.: US 8,870,126 B2
(45) Date of Patent: Oct. 28, 2014

(54) METHOD AND APPARATUS FOR CONTROLLING RAILWAY SAFETY SYSTEMS

(75) Inventors: Ulrich Bock, Braunschweig (DE); Bernhard Evers, Braunschweig (DE); Lars Schnieder, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 145 days.

(21) Appl. No.: 13/266,016

(22) PCT Filed: Apr. 8, 2010

(86) PCT No.: PCT/EP2010/054636

§ 371 (c)(1), (2), (4) Date: Oct. 24, 2011

(87) PCT Pub. No.: WO2010/121906

PCT Pub. Date: Oct. 28, 2010

(65) Prior Publication Data

US 2012/0037761 A1 Feb. 16, 2012

(30) Foreign Application Priority Data

Apr. 24, 2009 (DE) ..... 10 2009 019 302

(51) Int. Cl.

| | |
|---|---|
| ***B61L 25/02*** | (2006.01) |
| ***B61L 13/04*** | (2006.01) |
| ***B61L 29/00*** | (2006.01) |
| ***B61L 11/08*** | (2006.01) |
| ***B61L 7/06*** | (2006.01) |

(52) U.S. Cl.

CPC ..... *B61L 11/08* (2013.01); *B61L 13/04* (2013.01); *B61L 29/00* (2013.01); *B61L 7/06* (2013.01)

USPC ..... 246/124

(58) Field of Classification Search

USPC ..... 246/108, 111–114 A, 122 R, 124–126, 246/167 R, 182 R

See application file for complete search history.

(56) References Cited

U.S. PATENT DOCUMENTS

| | | | | |
|---|---|---|---|---|
| 5,727,758 | A * | 3/1998 | Penza et al. | 246/124 |
| 6,145,792 | A * | 11/2000 | Penza et al. | 246/167 A |
| 2011/0226910 | A1 | 9/2011 | Bock et al. | |

FOREIGN PATENT DOCUMENTS

| | | | |
|---|---|---|---|
| DE | 19905916 | A1 | 8/1999 |
| DE | 19927023 | A1 | 12/2000 |
| EP | 0985587 | A1 | 3/2000 |

(Continued)

OTHER PUBLICATIONS

Henning et al.: "Einschaltpunkte von Bahnübergängen im FFB-Konzept", Signal + Draht, Telzlaff Verlag GmbH Darmstadt, DE, vol. 90, No. 1-2, Jan. 1, 1998, pp. 20-23, XP001539964—English abstract on p. 23.

*Primary Examiner* — R. J. McCarry, Jr.

(74) *Attorney, Agent, or Firm* — Laurence A. Greenberg; Werner H. Stemer; Ralph E. Locher

(57) ABSTRACT

A method and an apparatus control railway safety systems, in particular train routing systems and railway crossing systems. In order to simplify the railway line infrastructure while increasing the safety level at the same time, it is provided that the vehicle emits an RFID—radio frequency identification—signal which contains vehicle data and is read and evaluated by a device on the railway line in order to generate control input variables.

1 Claim, 1 Drawing Sheet

(56) References Cited

FOREIGN PATENT DOCUMENTS

| | | | |
|---|---|---|---|
| EP | 1944215 | A2 | 7/2008 |
| EP | 1946989 | A2 | 7/2008 |
| EP | 2028076 | A1 | 2/2009 |
| WO | 2010060795 | A1 | 6/2010 |

* cited by examiner

METHOD AND APPARATUS FOR CONTROLLING RAILWAY SAFETY SYSTEMS

BACKGROUND OF THE INVENTION

Field of the Invention

The invention relates to a method for control of railroad safety systems, in particular train routing systems and level crossing systems, and to an apparatus for this purpose.

Railroad safety systems of a known type require an extensive trackside infrastructure. In order to explain this problem, train routing systems and level crossing systems will be considered in more detail in the following text, although the invention is not intended to be restricted to these specific applications.

Train routing systems use a so-called route stimulus to initiate the safety route setting by signal boxes. For correct route setting, the signal box technology and the connected control and display systems require information about the identity, for example the train number, of the vehicle, from which the route stimulus originated. Technically, this is implemented by passing on the train numbers from one train routing point to another, for example from one train station to another. This process is carried out via an infrastructure which is in parallel with the actual signal box technology.

In the case of level crossing systems, warning and barrier devices are switched on, controlled without any knowledge of the characteristics of the vehicle which is approaching the level crossing. The switch-on times must therefore be designed for a theoretical maximum speed, in order to be certain that railway barriers are closed in good time. In the case of relatively slow rail vehicles, this leads to the railway barriers being closed earlier than is operationally necessary. This in turn leads to the cross traffic being held up for an unnecessarily long time, with increased pollution emissions and additional noise being produced and—particularly in the case of level crossings with half barriers—to road traffic failing to observe the barriers, and bypassing them. In order to match the speed of the rail vehicle to the speed at the level crossing for switching the warning and barrier devices on and off, track side sensors are in some cases used for speed measurement, or linear elements, in particular switching-on and switching-off loops. However, these additional optimization measures are associated with considerable technical complexity, while at the same time impeding maintenance and track construction work.

BRIEF SUMMARY OF THE INVENTION

The invention is based on the object of specifying a method and an apparatus of this generic type which allow an increase in the safety level and the flexibility in the control of railroad safety systems, with a simplified infrastructure.

According to the method, the object is achieved in that an RFID—radio-frequency identification—signal which contains vehicle data is transmitted by the vehicle in order to produce control input variables, and is read and evaluated by a trackside device.

For this purpose, a vehicle appliance having an RFID—radio-frequency identification—transponder and a trackside device having an RFID reader are provided, with the trackside device having an evaluation unit for production of control input variables as a function of received vehicle data.

The use of wireless transponder/reader technology simplifies the track infrastructure.

In the case of train routing systems, there is no need whatsoever for a parallel infrastructure for passing on train numbers. Since the control input variables are produced by RFID systems which operate independently and autonomously, failures remain locally limited, thus resulting in increased reliability. Since no comprehensive network is required the flexibility can be increased by simpler matching to local circumstances. A route stimulus is initiated directly by the RFID signal by transmission of the vehicle data, in particular an ID, for example the train number, of the vehicle to the evaluation unit. The evaluation unit is in this case a component of the track infrastructure, for example of a control level, of the signal box. The signal box processes the train number together with the other state data as a control input variable for setting the vehicle-specific route, that is to say for controlling the appropriate routing elements such as switches and signals.

In the case of level crossing systems, it is particularly advantageous that no sensor system, in particular wheel sensors or conductor loops, needs to be laid in an exposed position in the track. This simplifies and reduces the cost of maintenance of the track superstructure.

In accordance with another embodiment of the invention, the RFID transponder influences the RFID reader essentially at a point while the vehicle is moving past the trackside device. The trackside readers are installed at the locations which are operationally required and at which the train number or some other vehicle-specific identification is read out, and is used as a route stimulus for train routing or for the—for example vehicle-type-dependent—optimization of the time at which the level crossing systems are switched on.

In one particularly preferred embodiment, continuous influencing is provided for the trackside device, with the RFID transponder interacting with the RFID reader while approaching the trackside device. The point signal transmission according to claim 3 is in this way extended in the form of a linear signal transmission. This allows the vehicle speed to be measured and monitored continuously. If acceleration is found, the control command for the next route section can be output at an earlier time, thus improving the operational safety. In comparison to point signal transmission, this makes it possible to even more extensively optimize the route stimulus and the switching-on time of warning and barrier devices at level crossings.

For this optimization, the vehicle appliance is designed to transmit static and dynamic train data. The static train data in this case comprises, for example, the train type and the acceleration capability, while the dynamic train data includes, for example, the actual speed and the actual acceleration. In the case of level crossing systems, the optimization, that is to say the shortening of the barrier closing times, results in a capacity increase for the road traffic and, as a consequence, reduced pollution emission, less noise being produced and, because of enhanced acceptance of the shorter barrier closing times, greater road safety.

In order to further increase the safety level, the trackside device has a transmitting module, and the vehicle appliance has a receiving module, with the transmitting module being designed to transmit state data of the rail road safety system to the receiving module. In dangerous states, for example if a level crossing barrier is not closed correctly, this makes it possible to initiate forced braking, provided that the appropriate train safety technology is available.

In the case of railroad safety systems for train routing, the vehicle appliance may have input means for manually inputting a desired route. This possibility of route selection by the driver is highly advantageous, particularly when entering depots, during shunting or on special journeys. The input of the desired route may be a complete route, or else the control command for a single switch, for example an electrically locally operated switch.

The invention will be explained in more detail in the following text with reference to illustrations in the figures, in which:

DESCRIPTION OF THE INVENTION

Figure 1:
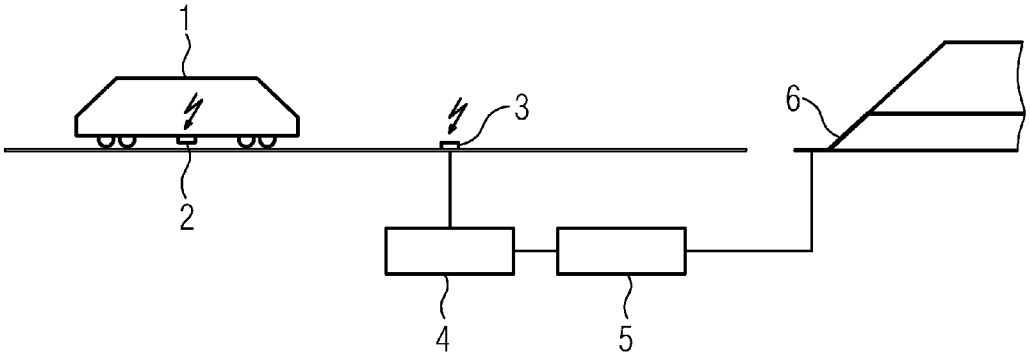
FIG. 1 shows a train routing system with point data transmission.

In the train routing system illustrated schematically in FIG. 1, a rail vehicle 1 is fitted to an RFID transponder 2 underneath. An RFID reader 3 is arranged on the track side, and is connected via a control level 4 to signal box 5. When the rail vehicle 1 moves past the RFID reader 3, the RFID transponder 2 transmits a train number of the rail vehicle 1 to the RFID reader 3. The train number is used for a route stimulus in the control level 4. The signal box 5 is then able to reserve and to set a safe route 6, leading to the destination, for the rail vehicle 1. The train number as read out at a point by the RFID reader 3 is used as a control input variable here.

Figure 2:
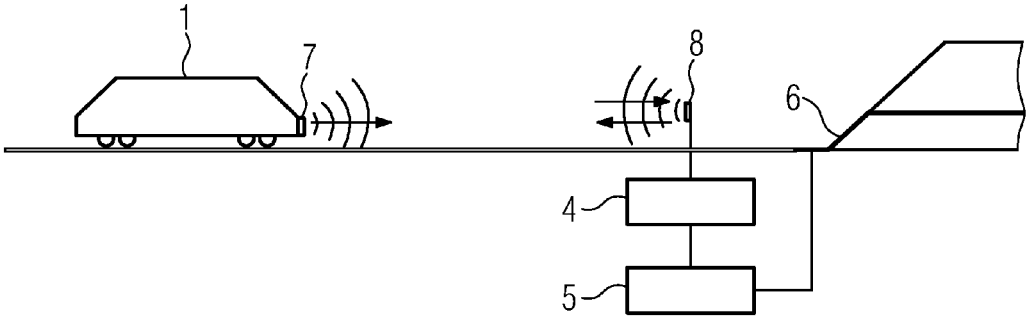
FIG. 2 shows a train routing system with continuous data transmission.

In contrast to this, in the case of train routing illustrated in FIG. 2, continuous RFID signal transmission is provided. For this purpose, an RFID transponder 7 is provided at the front on the rail vehicle 1 and interacts with an RFID transponder/reader 8, which is positioned alongside the track, as the rail vehicle 1 approaches the latter. In this case, in addition to the train number, the vehicle speed is also detected and is used to set the required route and additionally also to determine an operationally optimum time for the output of the route control command. If the rail vehicle 1 is currently accelerating, the control command for the following route is output at an earlier time, thus in the end resulting in improved safety even when trains are following one another very closely.

Figure 3:
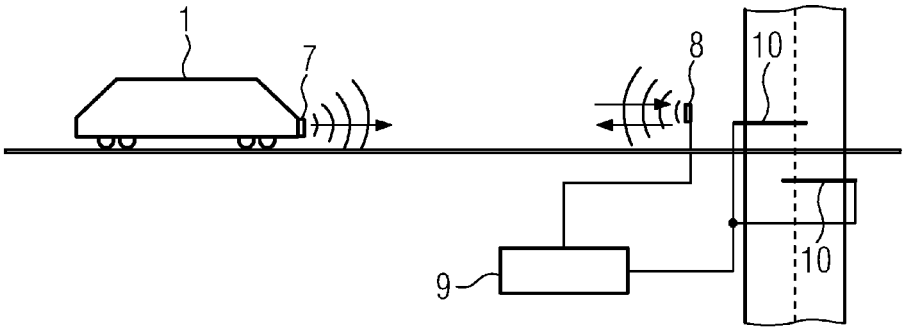
FIG. 3 shows a level crossing system with optimized time control.

The continuous RFID data transmission can also be used for controlling level crossing systems, as is illustrated in a simplified form in FIG. 3. In this case, the continuously measured speed or a derived acceleration value is used as a control input variable. A control device 9 is provided for this purpose, and determines an optimum time for the closing of the level crossing barriers 10 depending on the vehicle speed or acceleration.

In principle, a point RFID data transmission of the type illustrated in FIG. 1 can also be used for controlling level crossing systems. Since a speed measurement is then impossible, characteristic properties for the vehicle type, in particular the maximum speed, are transmitted by means of RFID and can therefore be used for partial optimization of the switching-on time for the process of closing the level crossing barriers 10.

If the train length is additionally transmitted by RFID, it is also possible to optimize the time for opening the level crossing barriers 10, and this time need not be based on a maximum possible train length.

The invention claimed is:

1. An apparatus, comprising:

a vehicle appliance having a radio-frequency identification (RFID) transponder and an input for manually inputting a desired route;

a trackside device having an RFID reader, said trackside device having an evaluation unit for production of control input variables in dependence on received vehicle data;

the apparatus programmed to:

transmit a radio-frequency identification (RFID) signal containing vehicle data by the vehicle to produce the control input variables, said vehicle appliance transmitting static and dynamic train data; and reading and evaluating the radio-frequency identification signal via said trackside device;

said RFID transponder communicating with said RFID reader continuously while the vehicle is approaching said trackside device; and said trackside device having a transmitting module, and said vehicle appliance having a receiving module, with said transmitting module transmitting state data of a rail road safety system to said receiving module.

* * * * *